US006386068B1

(12) United States Patent
Weissenborn

(10) Patent No.: US 6,386,068 B1
(45) Date of Patent: May 14, 2002

(54) APPARATUS FOR SHARPENING/ BEVELLING OF SKI OR SNOWBOARD EDGES

(76) Inventor: Richard K. Weissenborn, 3017 - 6th Street S.W., Calgary, Alberta (CA), T2S 2M1

( * ) Notice: Subject to any disclaimer, the term of this patent is extended or adjusted under 35 U.S.C. 154(b) by 0 days.

(21) Appl. No.: 09/403,079

(22) PCT Filed: Apr. 9, 1998

(86) PCT No.: PCT/CA98/00320

§ 371 Date: Jan. 21, 2000

§ 102(e) Date: Jan. 21, 2000

(87) PCT Pub. No.: WO98/46315

PCT Pub. Date: Oct. 22, 1998

(30) Foreign Application Priority Data

Apr. 15, 1997 (CA) ..... 2202723
Feb. 2, 1998 (CA) ..... 2228943

(51) Int. Cl.[7] ..... A63C 11/06
(52) U.S. Cl. ..... 76/83; 76/88
(58) Field of Search ..... 76/83, 88, 82; 451/552, 555, 558; 407/29.15

(56) References Cited

U.S. PATENT DOCUMENTS 3,914,839 A * 10/1975 Holdsworth ..... 76/88
4,030,382 A 6/1977 Nilsson et al. ..... 76/83
4,060,013 A * 11/1977 Thompson ..... 76/88
4,601,220 A * 7/1986 Yurick, Jr. ..... 78/83
4,663,993 A 5/1987 Weninger et al. ..... 76/83
4,721,020 A 1/1988 Stumpf ..... 76/83
4,850,252 A 7/1989 Sewell ..... 76/83
5,485,768 A * 1/1996 Vermillion ..... 76/83
5,701,787 A * 12/1997 Brill ..... 76/88

FOREIGN PATENT DOCUMENTS

DE 3233682 A1 9/1982
DE 3313367 A1 4/1983
DE 295 01 9204 2/1995
WO WO85/03008 7/1985

* cited by examiner

*Primary Examiner*—Hwei-Siu Payer
(74) *Attorney, Agent, or Firm*—Biebel & French

(57) ABSTRACT

An apparatus for the sharpening and/or bevelling of either a ski or a snowboard side edge or base edge (12). The apparatus comprises a guide (10) adapted to be held by the hand and moved lengthwise along an edge portion of a ski or snowboard while in contact with a surface thereof. The guide includes element for securing a file or the like (16) thereto at any one of a plurality of desired angular positions relative to the lengthwise direction of movement of the guide during use.

7 Claims, 12 Drawing Sheets

APPARATUS FOR SHARPENING/ BEVELLING OF SKI OR SNOWBOARD EDGES

BACKGROUND OF THE INVENTION

This invention relates to apparatus for the sharpening and/or bevelling of a ski or snowboard edges.

Until recently, ski designs have had a conventional side-cut (a turning radius of between 30 and 40 meters). With the recent increase in popularity of "shaped" or "super side-cut" skis, side cut has become more pronounced whereby a ski is more narrow in the waist than it is in the shovel and the tail, making it easier to carve a turn (a turning radius of between 10.5 and 30 meters). This is relevant as up until recently it has been possible to sharpen and bevel the side edge of a ski with conventional side-cut by positioning a file lengthwise on a guide to sharpen and bevel the side edge. This is not the best position to place the file however, as with even a small amount of side-cut, the teeth of the file only contact the edge at two places along the length of the file (front and back). This is even more pronounced with shaped skis, making the sharpening/bevelling job difficult and inefficient at best. Ski and snowboard camber is also a factor. U.S. Pat. 4,030,382 to Nilsson et al shows an attempt to compensate for this by using a clamping screw to bend a file blade between two support ribs.

A further factor is that the inherent angle of the teeth on commercially available files when positioned lengthwise on the metal edge does not produce the best cut when the file is pulled along the length of the edge. For example, the standard angle of teeth for a lathe cut file is 48 degrees. It is when the file is rotated somewhat so that the angle of the teeth is effectively 60 degrees or more that a better and more efficient cut is achieved (the file teeth are better oriented in relation to the direction of the cut along the edge).

Another consideration is that of providing the required bevel angle on the side edge or base edge. Leitinger (DE 3233682 A1) employs an eccentric disc system to achieve a selected edge bevel angle, which prior art system includes moving parts and general wear and tear can cause the angle to vary in an undesirable manner.

SUMMARY OF THE INVENTION

It is the main object of this invention to provide a ski/snowboard edge dressing system that alleviates problems inherent in prior art systems and that is simple, inexpensive, portable and easy to use while minimizing the fatigue and effort required to perform accurate and consistent edge sharpening/bevelling especially on "shaped" or "super side-cut" equipment as described above.

Accordingly the invention in one aspect provides: apparatus for the sharpening and/or bevelling of either a ski or a snowboard side edge or base edge, said apparatus comprising a guide adapted to be held by the hand and moved lengthwise along an edge portion of a ski or snowboard while in contact with a surface thereof, said guide including means for securing a file or the like thereto at any one of a plurality of desired angular positions relative to the lengthwise direction of movement of the guide during use such that a desired portion of the file length may make contact with the edge portion of the ski or snowboard and/or the teeth on the file may be oriented at a desired angle to the lengthwise direction of movement thus assisting in producing a consistent file cut and efficient edge sharpening or bevelling edges of the ski or snowboard.

In accordance with a preferred feature of the invention said means for securing comprises means for clamping said file or the like in said guide in any one of the desired angular positions.

As a further preferred feature of the invention said guide includes means to angularly orient the file or the like in a plane transverse to said lengthwise direction when positioned at a side edge portion of a ski or snowboard to establish a desired side edge geometry or bevel angle.

Preferably said means to angularly orient said file or the like includes plural elements of selected dimensions positionable in a selected manner in said guide to engage a surface of the ski or snowboard and to establish a selected angular orientation of said guide and the file or the like secured therein in said transverse plane relative to the ski or snowboard.

In accordance with a still further preferred feature of the invention said guide includes a slot-like passage therethrough for receiving said file or the like and said means for clamping comprising a clamp plate adapted to cooperate with a wall of said passage to secure the file or the like therein.

In a preferred embodiment of the invention said guide defines a pair of said passages generally at right angles to one another, each said passage having one said clamp plate respectively associated therewith.

In accordance with a further aspect of the invention there is provided: apparatus for the sharpening and/or bevelling of either a ski or a snowboard side edge or base edge, said apparatus comprising a guide adapted to be held by the hand and moved lengthwise along an edge portion of a ski or snowboard while in contact with a surface thereof, said guide including means for securing a file or the like thereto such that in use a desired portion of the file may make contact with the edge portion of the ski or snowboard thus effecting edge sharpening or bevelling, said guide including means to angularly orient the file or the like in a plane transverse to said lengthwise direction when positioned at the side or base edge portion of the ski or snowboard to establish a desired edge geometry or bevel angle.

In a preferred form of the further aspect of the invention said means to angularly orient said file or the like includes plural elements of selected dimensions (e.g. pegs) positionable in a selected manner in said guide to engage a surface of the ski or snowboard and to establish a selected angular orientation of said guide and the file or the like secured therein in said transverse plane relative to the ski or snowboard.

In a preferred embodiment of the further aspect of the invention said guide includes means for clamping said file or the like in said guide in any one of a plurality of desired angular positions relative to the lengthwise direction of movement of the guide during use so that a desired portion of the file length may make contact with the edge to promote efficient edge sharpening and bevelling. In this further aspect said guide preferably includes a slot-like passage therethrough for receiving said file or the like and said means for clamping comprising a clamp plate adapted to cooperate with a wall of said passage to secure the file or the like therein.

Further features and advantages of the invention will become more readily apparent from the following description of a preferred embodiment of same:

BRIEF DESCRIPTION OF VIEWS OF DRAWINGS

DETAILED DESCRIPTION OF THE PREFERRED EMBODIMENT

Figure 1:
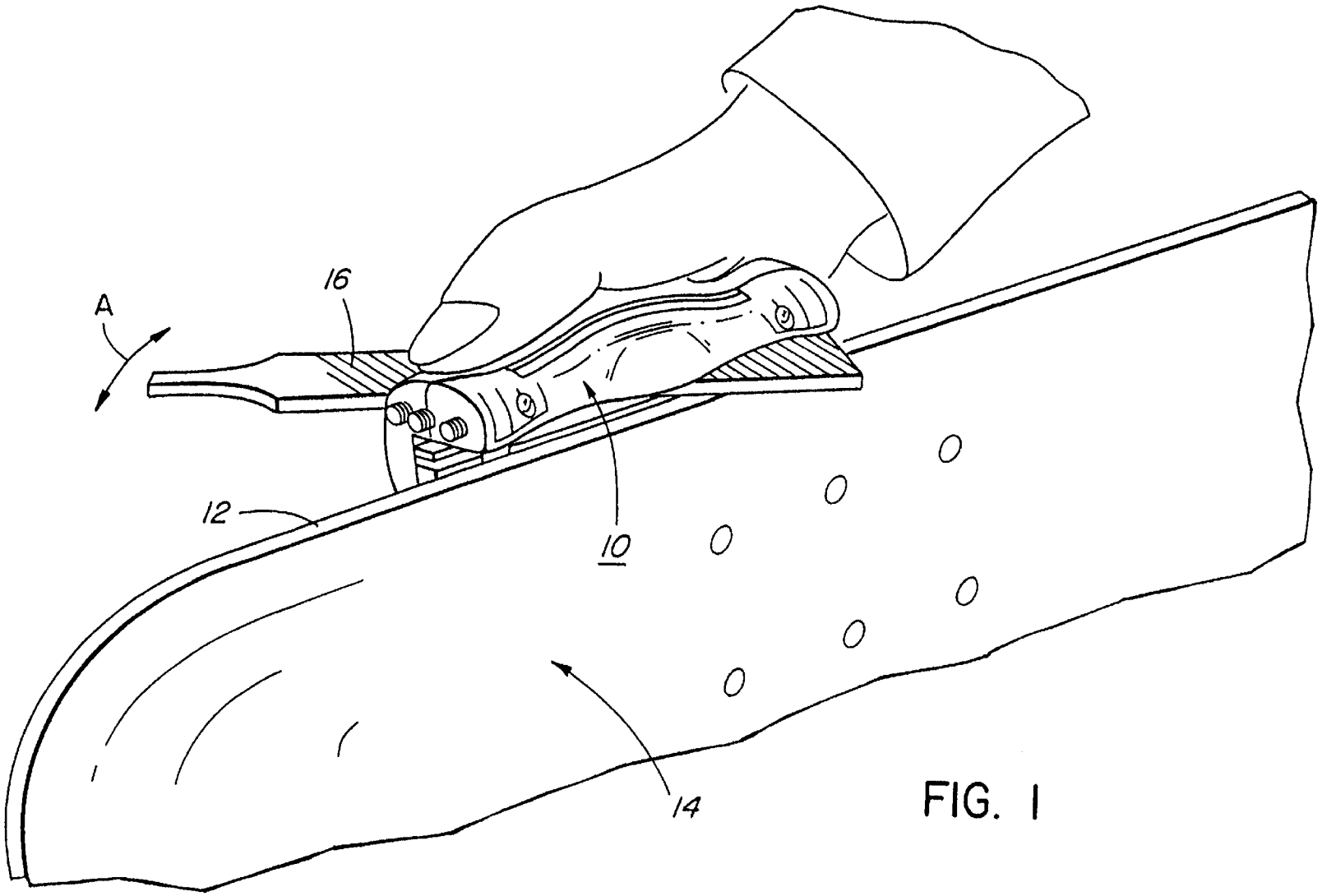
FIG. 1 is a perspective view of apparatus being used for the sharpening and/or bevelling of either a ski or a snowboard edge in accordance with a preferred embodiment of the invention, said view being from above and looking generally toward one side of the apparatus.
Figure 2:
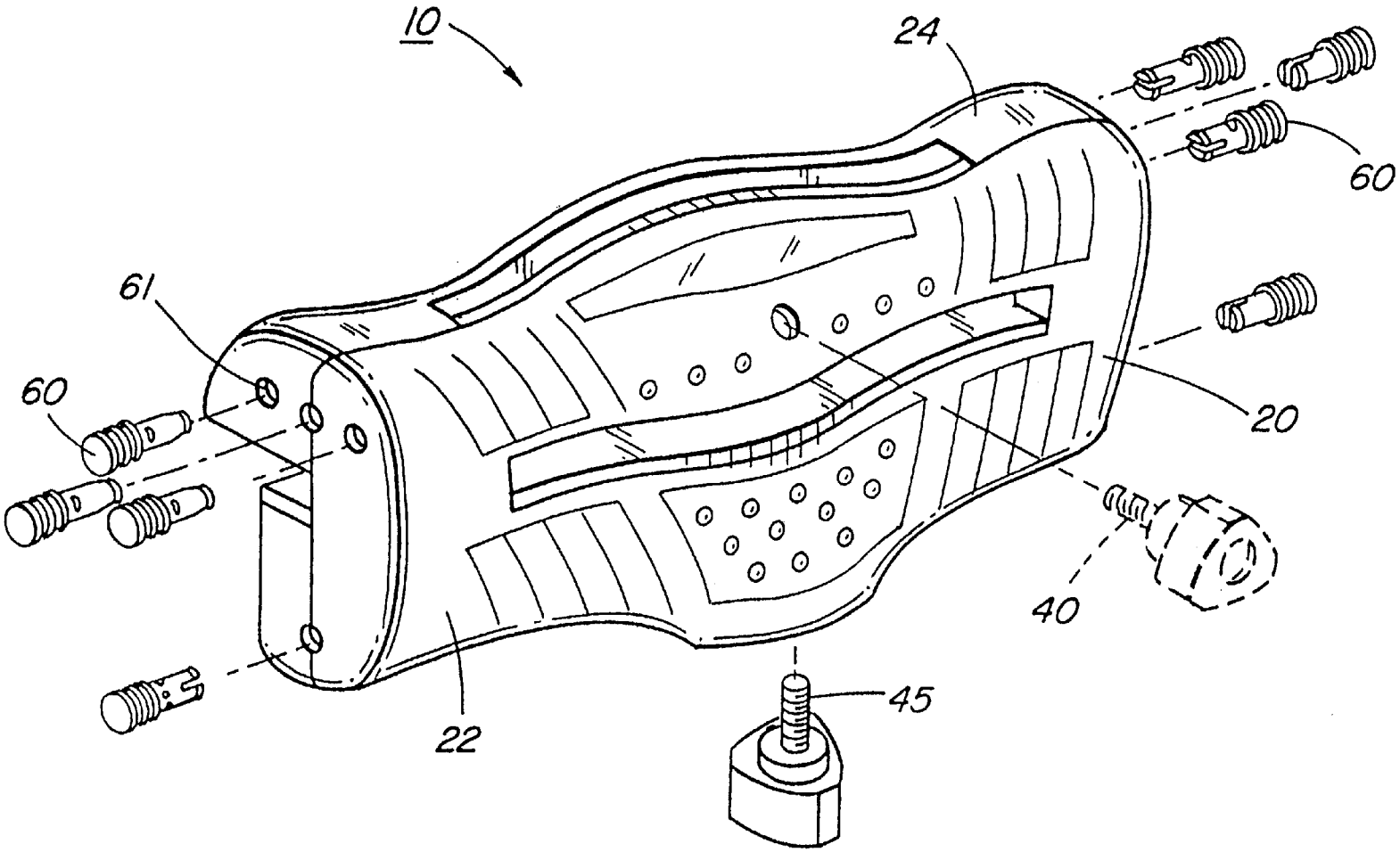
FIG. 2 is a further perspective view of the apparatus as seen from above and looking generally toward the opposing side thereof.
Figure 3:
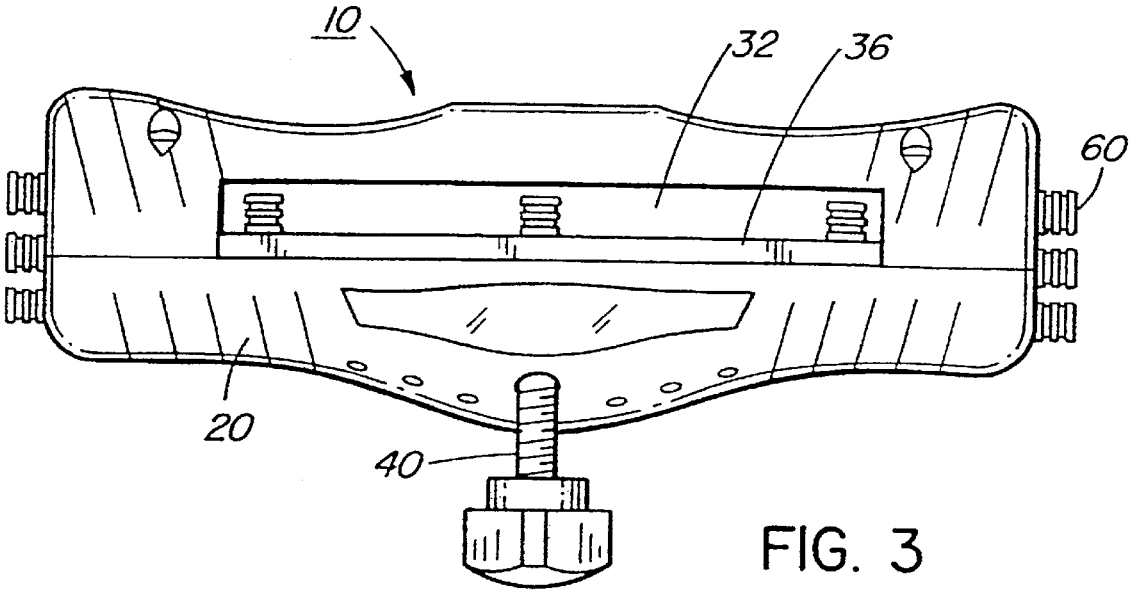
FIG. 3 is a top plan view of the apparatus.
Figure 4:
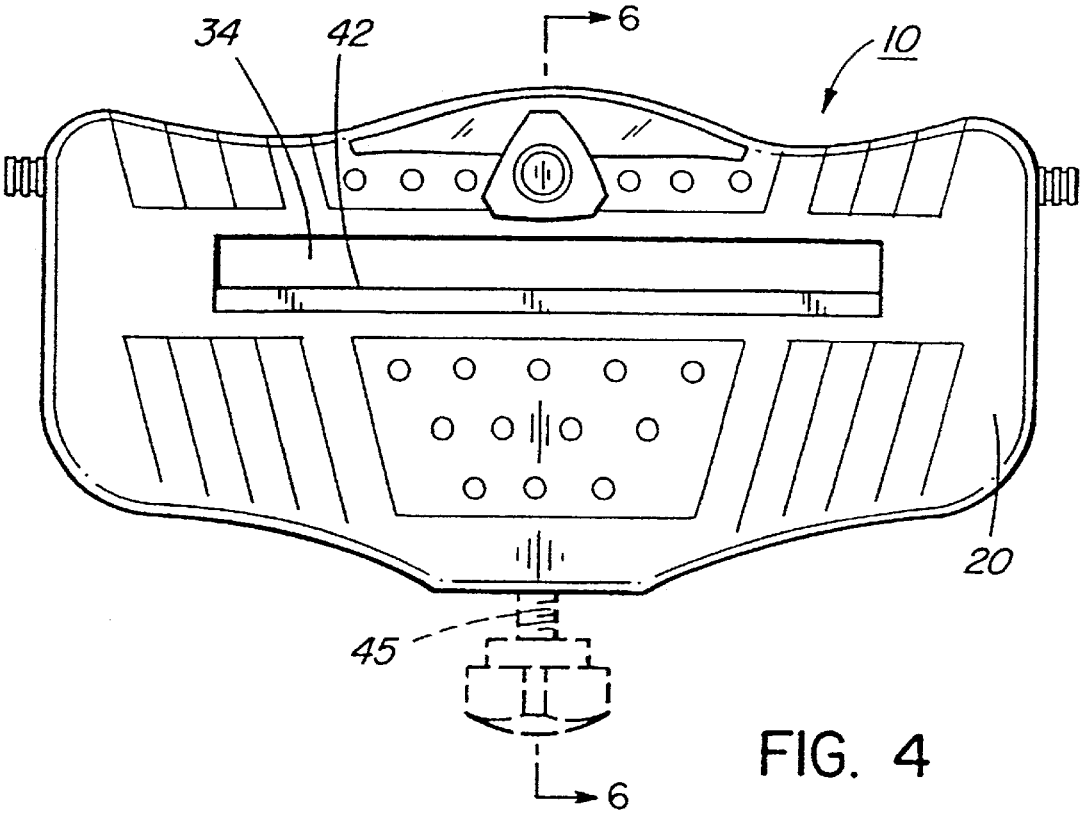
FIG. 4 is a side elevation view of the apparatus.

Referring now to the drawings there is shown at FIG. 1 an apparatus for the sharpening and/or bevelling of either a ski or a snowboard side edge or base edge. The apparatus comprises a guide 10 adapted to be held by the hand and moved lengthwise along a metal edge portion 12 of a ski or snowboard 14 while in contact with a surface thereof. The guide 10 includes means (to be described hereafter) for securing a file 16 or the like thereto at any one of a plurality of desired angular positions (see arrows A) relative to the lengthwise direction of movement of the guide 10 during use. Thus, a desired portion of the file length may make contact with the metal edge portion 12 of the ski or snowboard 14 and/or the teeth on the file 16 may be oriented at any desired angle to the lengthwise direction of movement. This assists the operator in producing a consistent file cut and efficient edge sharpening or bevelling regardless of the degree of camber shaping or side cut of the ski or snowboard. The means for securing comprises suitable means for clamping the file or the like in the guide 10 in any one of the desired angular positions. Additionally, the guide 10 includes special means to angularly orient the file 16 or the like in a plane transverse to said lengthwise direction when positioned at the side edge portion 12 of the ski or snowboard to establish a desired side edge geometry or bevel angle. All of the above features will now be described in some detail.

The expression "file" includes a variety of cutting/polishing implements which can be clamped in the guide 10 including rough (panzer) files, smooth (mill) files, x-course, coarse, fine and extra fine diamond whetstones, deburring stones etc. as well as combination of cutting and/or polishing implements (i.e. a segment of file for cutting the edge while a segment of whetstone polishes the edge simultaneously). This allows the file guide 10 to be used for a variety of operations including honing, deburring and polishing as well as rough and smooth filing.

Figure 5:
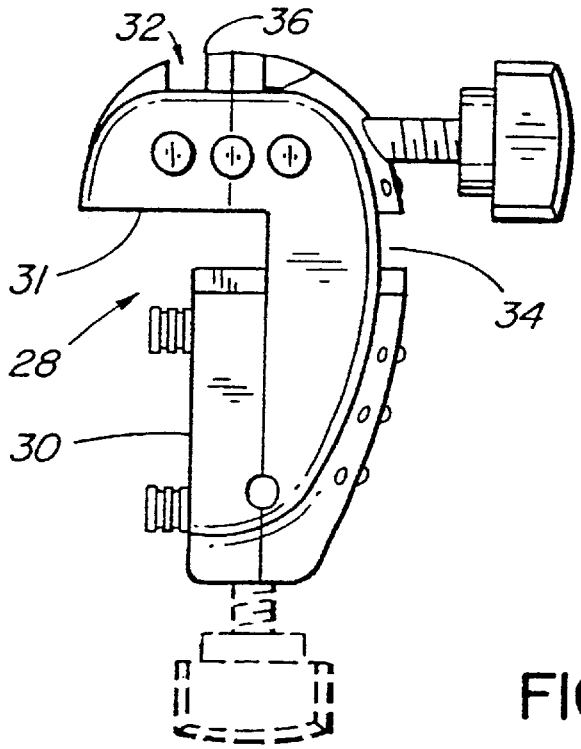
FIG. 5 is an end elevation view of the apparatus, the opposing end being a mirror image thereof.
Figure 6:
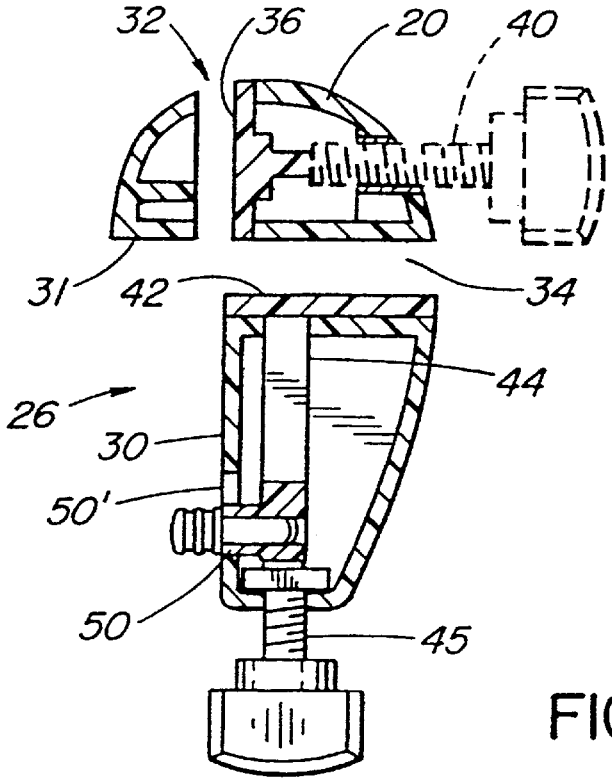
FIG. 6 is a cross-section view taken along the line 6—6 of FIG. 4.
Figure 7:
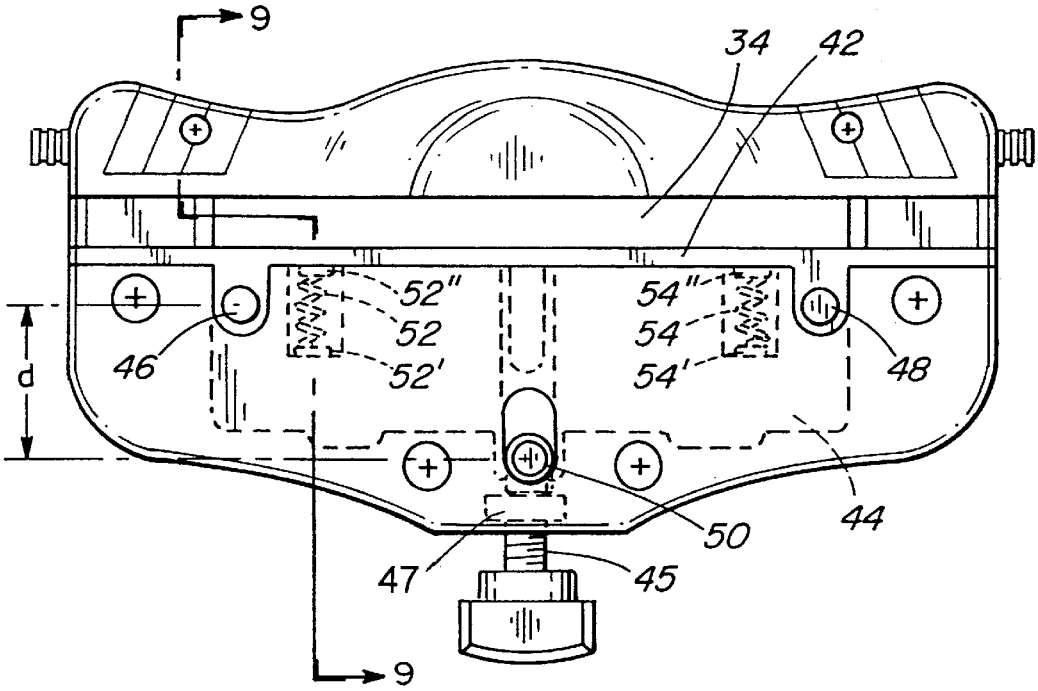
FIGS. 7 and 8 are side elevation views of that side of the apparatus which is opposite to the side shown in FIG. 4.
Figure 8:
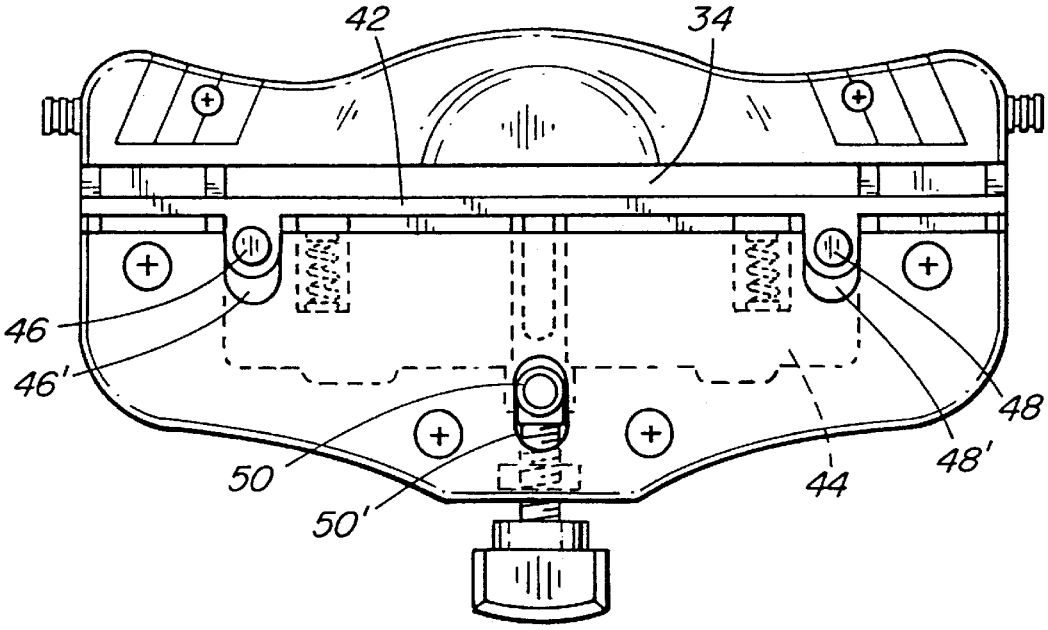

The guide 10 comprises a body or housing 20, the rear and top faces 22, 24 of which are smoothly contoured to facilitate the gripping of the tool by the user and to provide an attractive appearance. As best seen in FIGS. 5 and 6, the lower part of frontal face 26 of the housing 20 is recessed or stepped inwardly with the recess 28 being of inverted L-shape and being defined in part by a flat face plate 30 and a further wall 31 at right angles thereto. The upper portion of housing 20 is provided with an elongated vertical slot 32 which is generally coplanar with the face plate 30. A horizontal slot 34 also extends through housing 20, the upper wall of the slot being defined by the further wall 31. Slots 32 and 34 are thus at right angles to one another and their purpose is to receive one or more files 16 in the course of base edge or side edge preparation as described hereafter.

Figure 9:
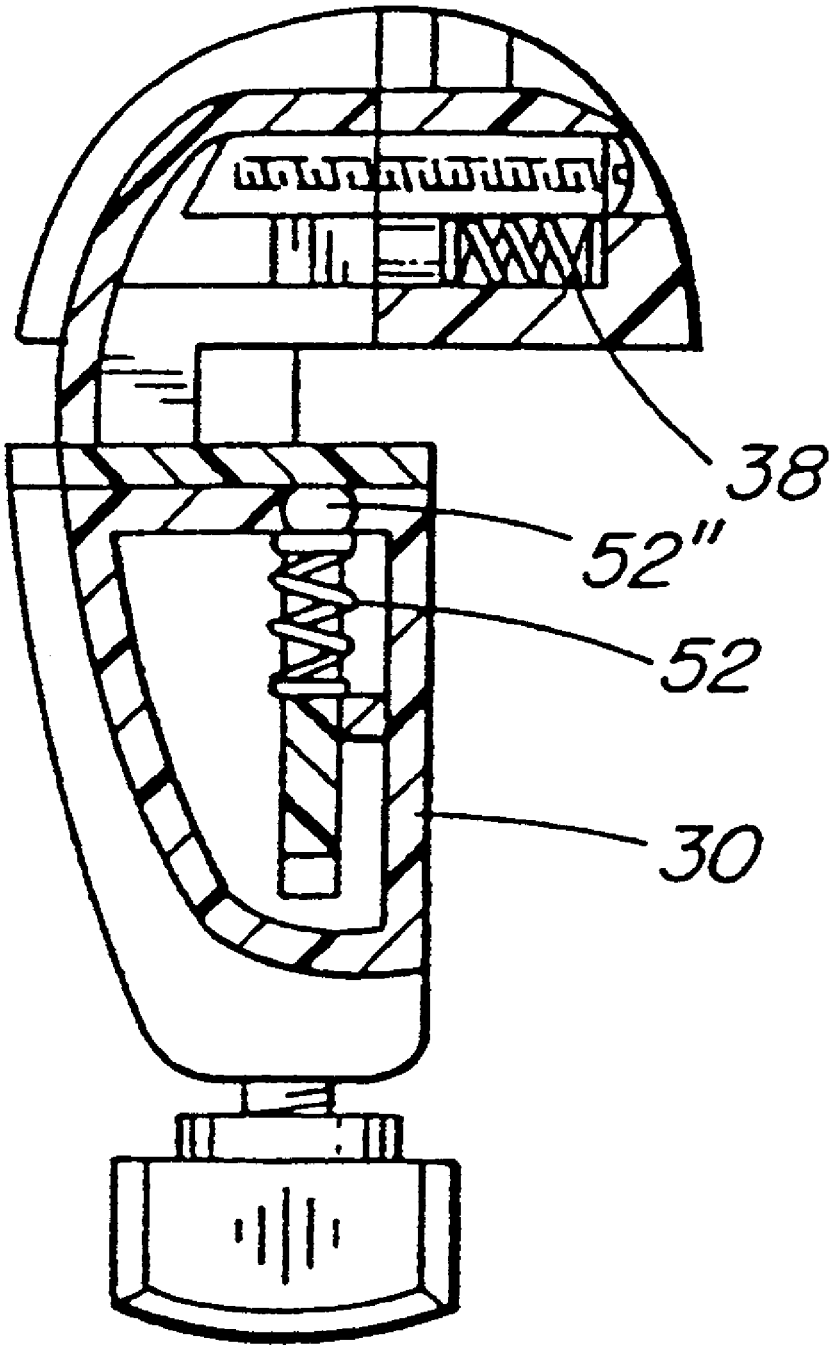
FIG. 9 is a section view taken alone section line 9—9 of FIG. 7.

The slot 32 is provided with an elongated clamp plate 36 which is co-extensive with slot 32. Coil springs 38 (FIG. 9) at opposing ends of the pate 36 bias the clamp plate toward the end of a clamp screw 40 threaded into the upper portion of the housing 20. When clamp screw 40 is tightened the clamp plate 36 is urged toward the opposing walls of the slot 32 thus enabling the file 16 to be securely clamped in slot 32 when required.

In similar manner, the transverse slot 34 is provided with an elongated clamp plate 42 (FIGS. 5–8). Clamp plate 42 is provided with a downwardly depending rigid web 44, the lower extremity of which abuts the end of a clamp screw 45 threaded through a nut 47 mounted in housing 20. Web 44 also carries three integral sockets 46, 48, 50 for receiving guide orienting peas to be described hereafter. These sockets project through face plate 30 via corresponding slots 46', 48', 50' which thus allow freedom of movement of clamp plate 42 and its web 44 as the clamp screw 45 is tightened and loosened. In order to bias the clamp plate 42 toward the clamp screw 45 and toward the open position at all times, a pair of coil compression springs 52. 54 are mounted in recess 52', 54' in web 44 with the lower ends of these springs bearing against the web while the upper ends bear against respective abutments 52", 54" fixed to the interior of the housing 20. Hence, when clamp screw 45 is tightened, the clamp plate 42 is urged upwardly into the slot 34 from the position shown in FIG. 7 to the position shown in FIG. 8. Hence, a file disposed in slot 34 can be clamped securely therein in any desired orientation by virtue of the action of clamp plate 42.

It is noted here that, in practice, only a single one of clamp screws 40 45 is actually supplied with the tool. Depending on the operation being carried out, the file 16 is only located in one or other of the slots 32 and 34 at any one time and hence the clamp screw is simply removed from one location and threaded into the other location as required. Two screws 40, 45 one being in phantom, are shown here simply for convenience of illustration.

Figure 16:
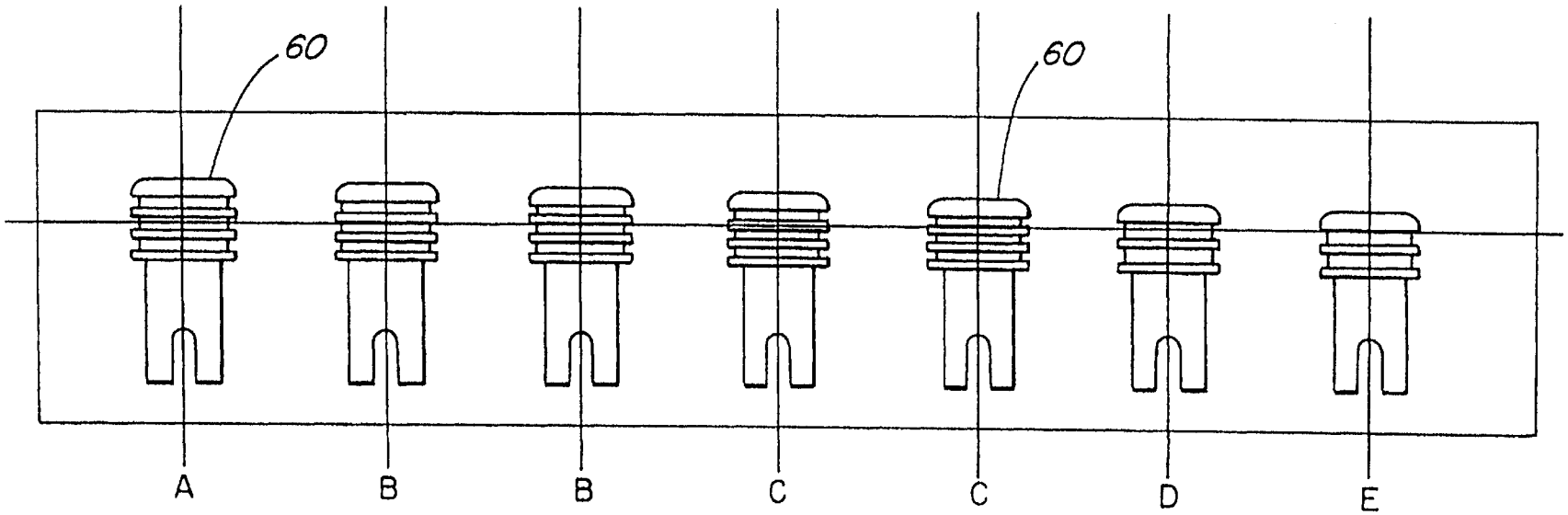
FIG. 16 is a view of the several pegs used to achieve the desired edge bevel angle, showing the variation in length from minimum to maximum.

Reference will now be had to the guide pegs which are used to establish base edge and side edge bevel angles. The guide pegs 60 are shown in FIG. 16. The pegs 60 are of a sturdy long wearing material such as nylon and they have bifurcated ends adapted to snap-fit into the sockets 46, 48, 50 described above such that in use their head portions bear against a surface of the ski/snowboard. The effective heights of the pegs are selected in accordance with the dimensions of the guide, especially the distance "d" (FIG. 7) between the socket pair 46, 48 and the socket 50. Pairs of equal length secondary pegs 60, e.g. pegs 60B or 60C are placed in sockets 46, 48. A longer primary peg 60A or a shorter primary peg 60D or 60E is placed in socket 50. Hence, with the guide 10 in position and with the selected pegs 60 contacting a surface of the ski/snowboard as described hereafter, a desired angular orientation can be achieved to enable the desired edge bevel angle to be created. The length differences in the pegs may be in 1 mm increments and by proper selection of pegs, a substantial variation in bevel angle for both side edge and base edge work can be achieved. When not in use, the pegs 60 are stored in sockets 61 located at opposing ends of the guide housing.

Figure 10:
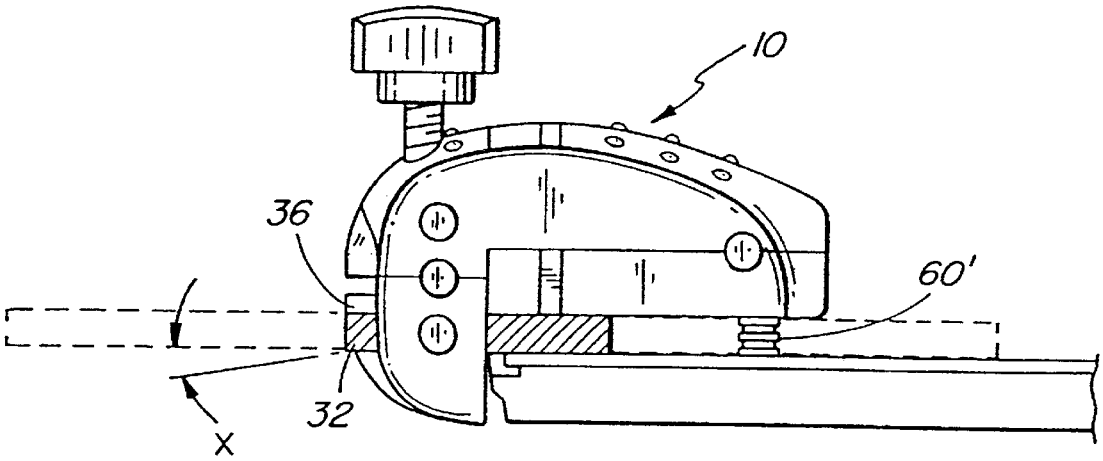
FIG. 10 is a further end elevation view of the appararus showing the same in position for the dressing or preparation of the base edge of the ski or snowboard.
Figure 11:
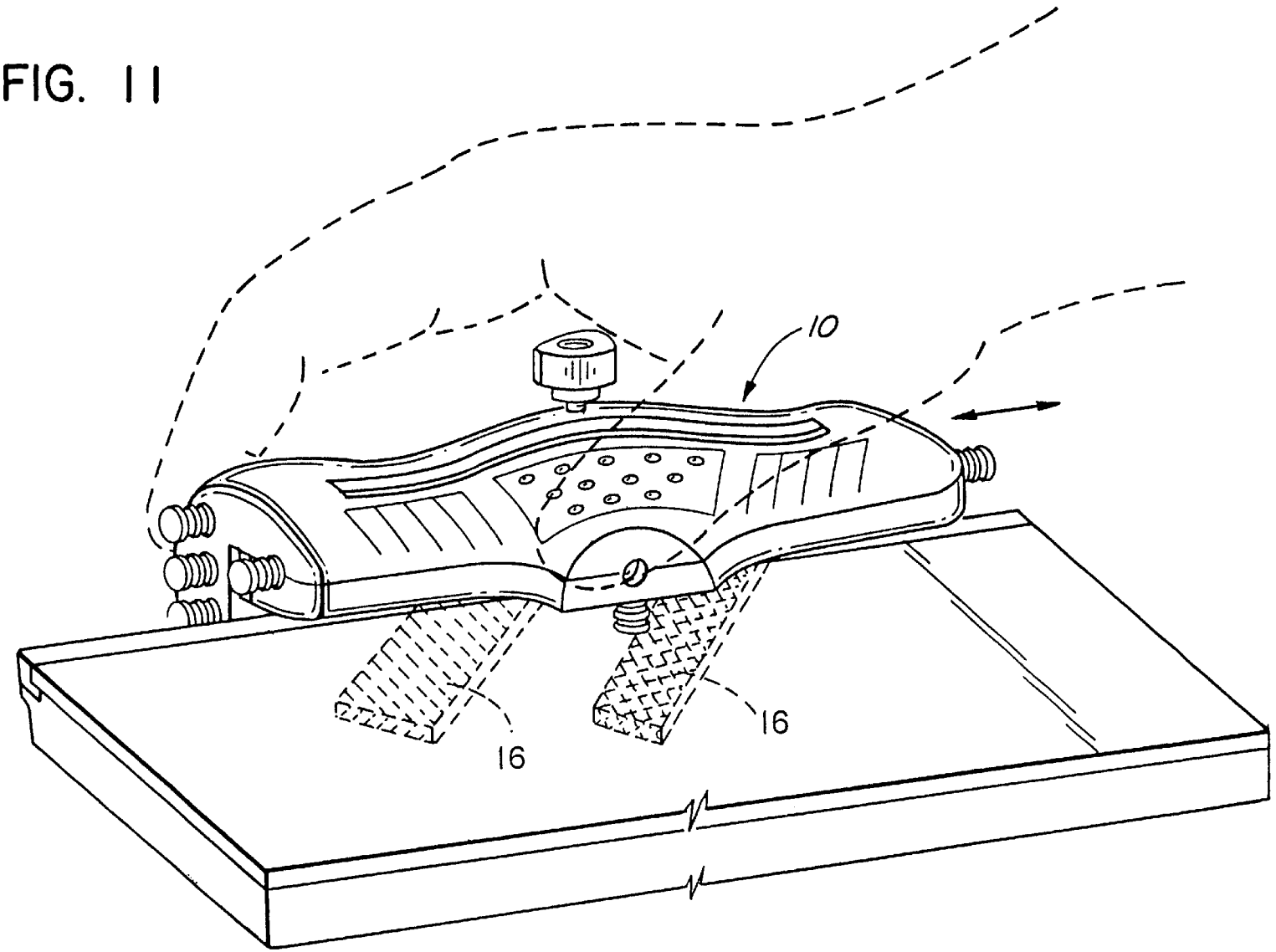
FIG. 11 is a further perspective view of the apparatus further illustrating metal base edge dressing operations as in FIG. 10.
Figure 14:
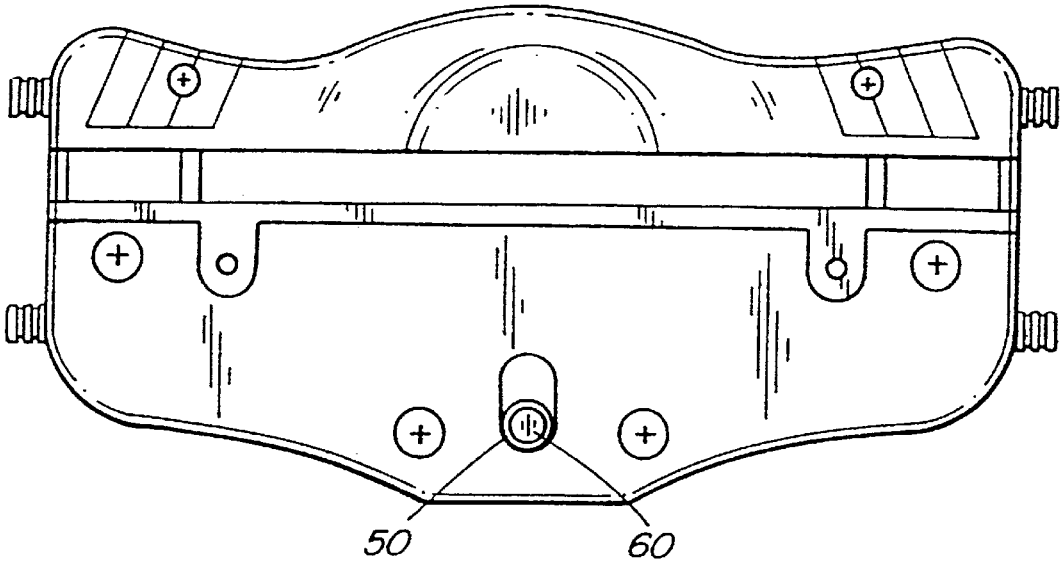
FIGS. 14 and 15 are side elevational views similar to FIGS. 7 and 8 but illustrating the selective positioning of pegs of selected dimensions thereby to establish a selected angular orientation of the guide and file secured therein whereby to establish a desired base edge and side edge bevel angles respectively.

FIGS. 10, 11 and 14 illustrate base edge preparation. Here the file 16 is inserted through slot 32 of the guide 10 and secured by clamp plate 36 in any desired orientation from lengthwise of the guide (shown in solid lines) to transversely thereof (shown in dashed lines). The secondary pegs have been removed and stored and only a single primary peg 60' remains in socket 50. The biasing springs 52, 54 ensure that the clamp plate 42, web 44 and primary socket 50 and peg 60' are in the correct "home" position to help ensure a consistent edge bevel angle. By selecting the correct length of the primary peg 60', the desired base edge bevel angle "X", (shown in exaggerated fashion in FIG. 10) can be achieved. The base edge preparation process is farther illustrated in FIG. 11 wherein the guide is shown here clamping a pair of files 16 (e.g., a mill file and a fine whetstone) with the guide 10 being moved along the edge of the ski/snowboard several times until the required degree of sharpening and correct base edge bevel angle have been achieved.

Figure 12:
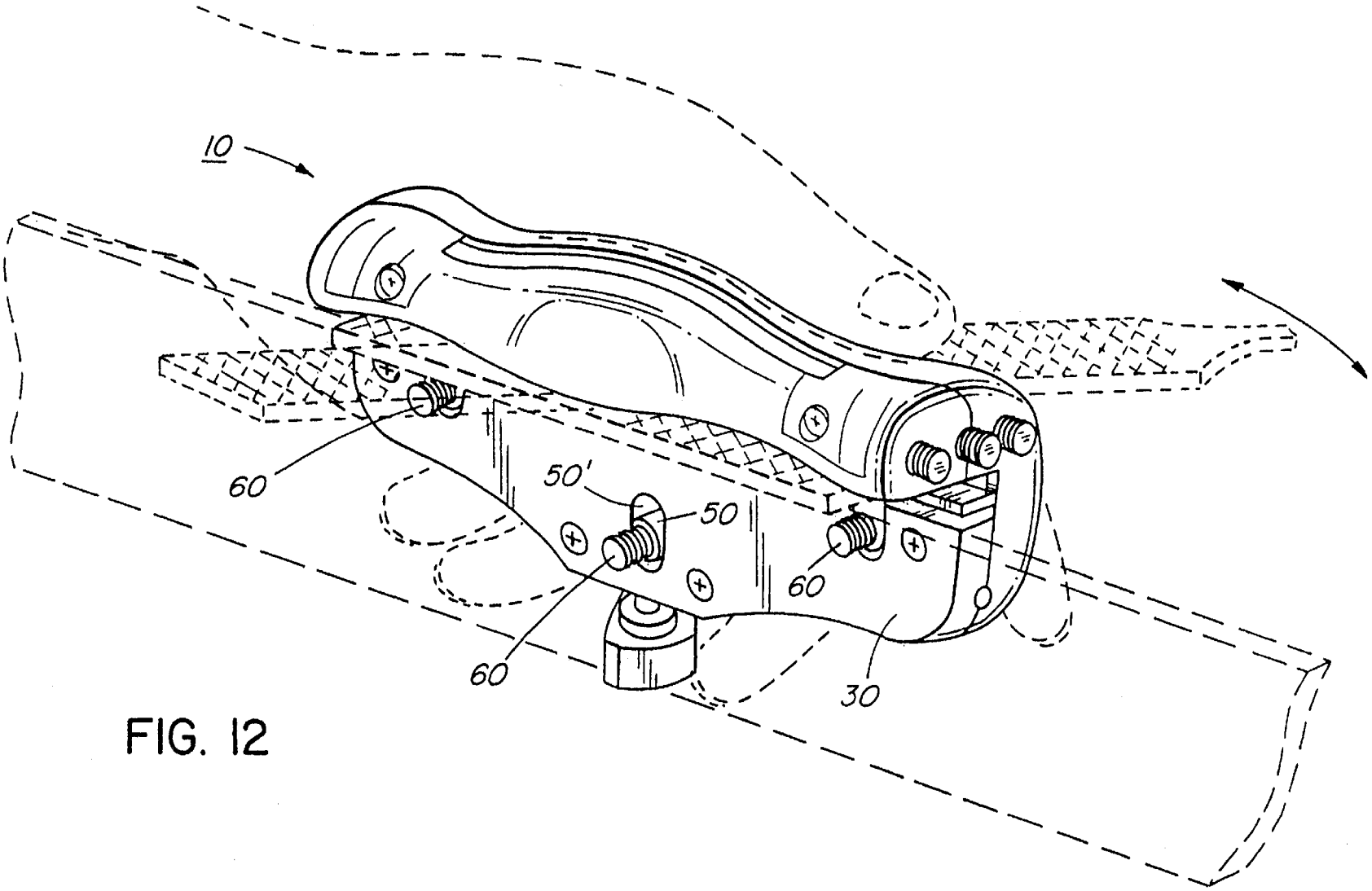
FIG. 12 is a further perspective view of the apparatus showing the same positioned for the sharpening and/or bevelling of a side edge of a ski or snowboard.
Figure 13:
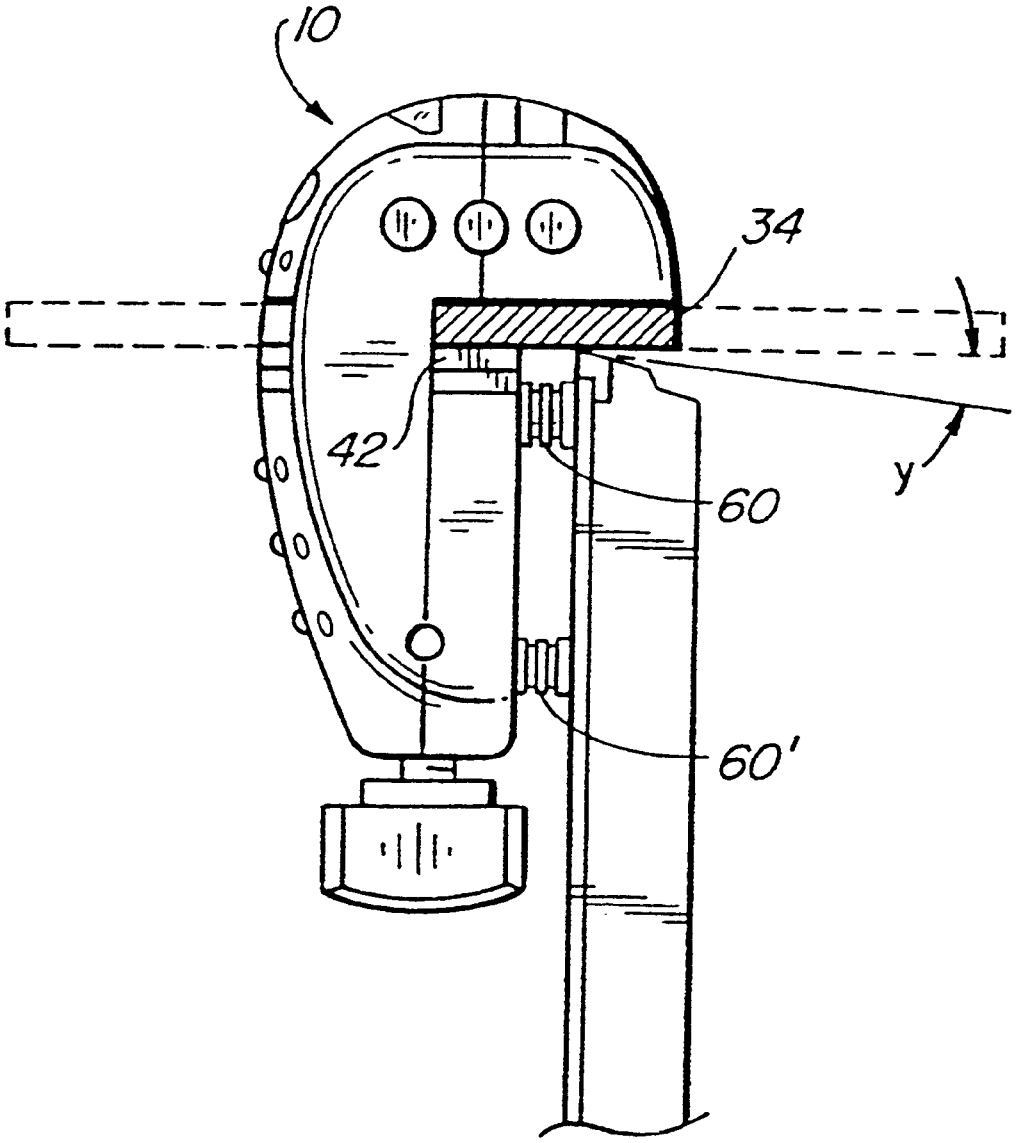
FIG. 13 is an end elevation view of the apparatus positioned for the same purposes as indicated for FIG. 12.
Figure 15:
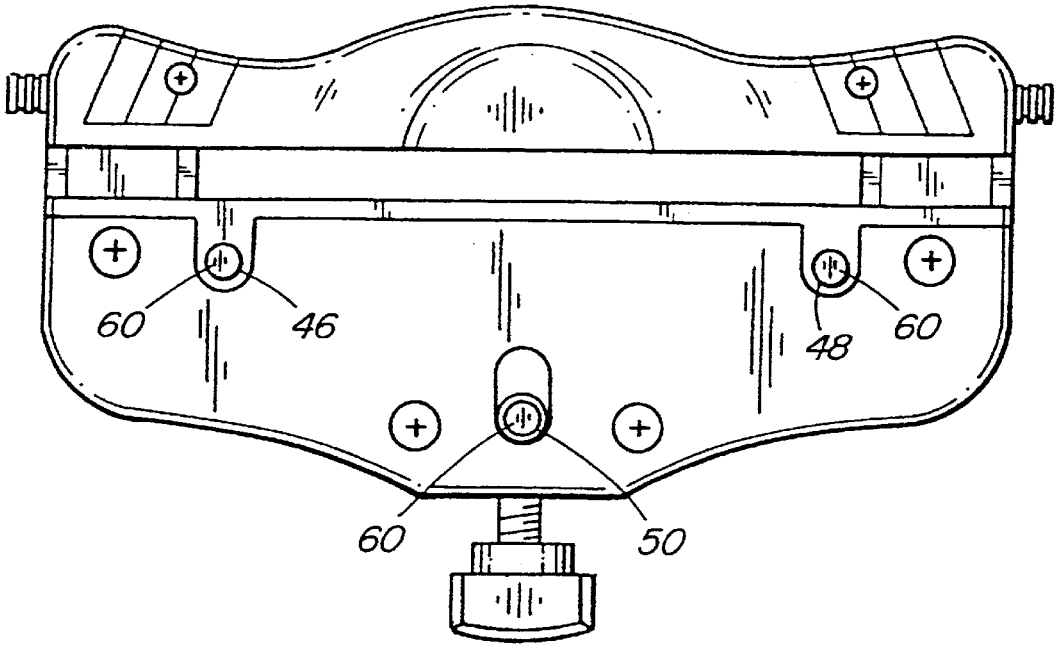

Side edge preparation is illustrated in FIGS. 12, 13 and 15. In this case, the file 16 is inserted through slot 34 of guide 10 and secured by clamp plate 42 in any desired orientation from lengthwise of the guide to transversely thereof. Both the secondary pegs 60 and primary peg 60' are positioned in their respective sockets 46, 48 and 50 (FIG. 15). By selecting the correct relative lengths of the primary and secondary pegs 60, the correct side edge bevel angle 'Y' (shown in exaggerated fashion in FIG. 13) can be achieved.

It should be realized that the entire side edge of the ski/snowboard i.e. both the metal edge and the remaining exposed side edge material of the ski/snowboard can be bevelled with the use of guide 10. To achieve this, the longest primary peg 60' is used in combination with the shortest secondary pegs 60 (see FIG. 13). This provides a relatively large side edge bevel angle Y and enables the side edge board material to be cut or bevelled alone or in concert with the metal side edge. A short section of a Pansar file can be used to advantage here.

In general, as regards the pegs 60 and depending on the position and length of the pegs used, the same peg is able to produce two different bevel angles (one side edge bevel angle and one base edge bevel angle). Also in the illustrated embodiment, the peg used to produce a certain side edge bevel angle can produce exactly half that bevel angle when used to bevel the base edge, (e.g. the peg used to create a 1 degree side edge bevel can also be used to create a ½ degree base edge bevel). This is but one illustration of the flexibility and versatility of the tool.

Because the filing/polishing/cutting device is clamped in position within the guide body at the desired angular orientation by the clamp plate, the file remains flat through its length. As a result the edge bevel angle achieved is more precise than can be achieved by bending the file (see previously cited Nilsson et al) as a clamping screw tends to distort the underlying file teeth.

A substantial number of commercially available filing/polishing/cutting devices can be employed by the file guide. In other words, the same guide can be used for honing, deburring and polishing as well as rough and smooth filing.

As noted above, two or more segments of files/polishing/cutting devices can be clamped in the file guide at one time in order to perform more than one operation in a single pass down the length of the ski/snowboard metal edge (i.e. a segment of file cuts the edge while a segment of whetstone polishes the edge simultaneously). This includes the ability to place a module combining two or more segments into the guide as a single unit.

The file guide is designed so that the file for side edge sharpening/bevelling is not placed on the upper surface of an angular member as in U.S. Pat. No. 4,721,020 to Stumpf. Rather it is clamped in the guide body by means of the clamp plate, as described above. By clamping the file in this way, a special chip receiving recess or slot is not necessary as there is a void under the file where metal filings can escape from the file without the possibility of building-up and becoming embedded in the plastic base of the ski/snowboard as is often the case when using a file on a prior art guide member with or without a chip receiving recess.

A preferred embodiment of the invention has been described and illustrated by way of example. Those skilled in the art will realize that various modifications and changes may be made while still remaining within the spirit and scope of the invention. Hence the invention is not to be limited to the embodiment as described but, rather, the invention encompasses the fill range of equivalencies as defined by the appended claims.

What is claimed is:

1. Apparatus for the sharpening and/or bevelling of either a ski or a snowboard side edge or base edge, said apparatus comprising a guide adapted to be held by a hand of a person using the guide and moved lengthwise along an edge portion of a ski or snowboard while in contact with a surface thereof, said guide including a clamp for securing a file in said guide at any one of a plurality of desired angular positions relative to the lengthwise direction of movement of the guide during use such that a desired portion of the file length may make contact with the edge portion of the ski or snowboard and/or the teeth on the file may be oriented at a desired angle to the lengthwise direction of movement thus assisting in producing a consistent file cut and efficient edge sharpening or bevelling of the edges of the ski or snowboard, said guide including elements to angularly orient the file in a plane transverse to said lengthwise direction when positioned at a side edge portion of a ski or snowboard to establish a desired side edge geometry or bevel angle, said elements to angularly orient said file including plural pegs of selected lengths removably positionable by the user in a selected manner in said guide to engage a surface of the ski or snowboard and to establish a selected angular orientation of said guide and the file secured therein in said transverse plane relative to the ski or snowboard.

2. Apparatus for the sharpening and/or bevelling of either a ski or a snowboard side edge or base edge, said apparatus comprising a guide adapted to be held by a hand of a person using the guide and moved lengthwise along an edge portion of a ski or snowboard while in contact with a surface thereof, said guide defining a pair of slot-shaped passages therethrough generally at right angles to one another and each adapted to receive a file therein, each said passage having a clamp plate respectively associated therewith adapted to co-operate with a wall of the associated passage such that a file may be clamped in one passage or the other depending on whether side edge or base edge sharpening and/or bevelling is selected and at any one of a plurality of desired angular positions of the file relative to the lengthwise direction of movement of the guide during use such that a desired portion of the file length may make contact with the edge portion of the ski or snowboard and/or the teeth on the file may be oriented at a desired angle to the lengthwise direction of movement thus assisting in producing a consistent file cut and efficient edge sharpening or bevelling of the edges of the ski or snowboard.

3. Apparatus for the sharpening and/or bevelling of either a ski or a snowboard side edge or base edge, said apparatus comprising a guide adapted to be held by a hand of a person using the guide and moved lengthwise along an edge portion of a ski or snowboard while in contact with a surface thereof, said guide including a clamping device for securing a file therein such that in use a desired portion of the file may make contact with the edge portion of the ski or snowboard thus effecting edge sharpening or bevelling, said guide including plural interchangeable elements of selected dimensions positionable by the user of the device in selected locations in said guide to engage a surface of the ski or snowboard and to establish a selected angular orientation of said guide and the file in a plane transverse to said lengthwise direction when positioned at the side or base edge portion of the ski or snowboard to establish a desired edge geometry or bevel angle.

4. Apparatus according to claim 3 wherein said clamping device enables said file to be secured in said guide in any one of a plurality of desired angular positions relative to the lengthwise direction of movement of the guide during use to promote efficient edge sharpening and bevelling.

5. Apparatus according to claim 4 wherein said guide includes at least one slot-shaped passage therethrough for receiving said file and said clamping device comprises a clamp plate adapted to cooperate with a wall of said slot-shaped passage to secure the file between the clamp plate and the wall.

6. Apparatus according to claim 5 wherein said guide defines a pair of said slot-shaped passages generally at right angles to one another, each said passage having one said clamp plate respectively associated therewith so that a file may be positioned in either one of said passages depending on whether a side edge or a base edge is being sharpened and/or bevelled.

7. Apparatus according to claim 3 wherein said plural elements comprise pegs of predetermined lengths adapted to removably fit into apertures in selected locations in said guide to establish said selected angular orientation.

* * * * *